United States Patent [19]

Bingener

[11] Patent Number: 4,638,545

[45] Date of Patent: Jan. 27, 1987

[54] PROCEDURE FOR COATING AND HEAT INSULATING OF WALLS AND CEILINGS, ETC., AND DEVICE FOR CARRYING OUT THE PROCEDURE

[75] Inventor: Hans Bingener, Friedrichshafen, Fed. Rep. of Germany

[73] Assignee: Durol Flying Lindauer Ikh Montage GmbH, Fed. Rep. of Germany

[21] Appl. No.: 706,713

[22] Filed: Feb. 28, 1985

[30] Foreign Application Priority Data

Feb. 29, 1984 [DE] Fed. Rep. of Germany ..... 3407459

[51] Int. Cl.[4] ..... B23P 19/04; E04C 1/00; E04C 3/16; E04F 13/06

[52] U.S. Cl. ..... 29/460; 29/526 R; 52/309.4; 52/364; 52/371; 52/743; 52/744; 52/746

[58] Field of Search ..... 52/364, 371, 309.4, 52/743, 744, 746; 29/460, 526 R

[56] References Cited

U.S. PATENT DOCUMENTS

| | | | |
|---|---|---|---|
| 3,364,640 | 1/1968 | Guddal | 52/364 |
| 4,288,962 | 9/1981 | Kavanaugh | 52/743 |
| 4,489,530 | 12/1984 | Chang | 52/744 X |

*Primary Examiner*—Michael R. Lusignan
*Attorney, Agent, or Firm*—McGlew and Tuttle

[57] ABSTRACT

A method of applying an insulation coating to a wall surface comprises applying strips of a length or height of the insulation to be applied to the wall surface so that they are deposed outwardly of the wall surface up to the desired thickness of the insulating coating, spraying the coating between adjacent strips of a thickness up to the surface of the strips, and thereafter smoothing the coating surface which has been applied. The invention also includes a chainsaw construction for smoothing the surface in which the saw has a blade length at least as long as the expected coating widths and the spacing of the strips which includes a plurality of chain links having cutting tips and advantageously small brushes a affixed to the links to further smooth or remove the dust from the coated surfaces.

8 Claims, 2 Drawing Figures

PROCEDURE FOR COATING AND HEAT INSULATING OF WALLS AND CEILINGS, ETC., AND DEVICE FOR CARRYING OUT THE PROCEDURE

FIELD AND BACKGROUND OF THE INVENTION

The invention relates to a procedure and a device or fixture for carrying out the procedure of coating and heat insulating of walls, ceilings, etc. by means of a heat insulating layer applied by spray-coating, in particular a polyurethane layer.

The improved insulation of buildings is more and more important due to increasing fuel costs and the necessity of fuel economy. Both the interior and the exterior of walls have been insulated with insulating boards of hard aerated plastics (polystyrene). After these boards have been stuck onto the wall, the joints must be treated with filler, and the entire surface must be covered by an adequate matting in order to prevent cracking of the plaster to be applied on the outside. A disadvantage of this procedure is that optimum adhesion between the hard aerated foam boards and the base material of the wall is not always ensured, and that the subsequent treatment necessary for applying the plaster is time consuming and expensive.

It is also known to apply a polyurethane coat on roofs. In this case in general, the coat or layer is sprayed on the surface of the roof in a substantially uncontrolled way, and the finished coat is painted for protection purposes. This procedure has the disadvantage that the surface is very rough and uneven, and not suitable for further use.

SUMMARY OF THE INVENTION

The invention provides a procedure for coating and heat insulating of walls, ceilings, etc., which avoids the abovementioned disadvantages, and which can be effected in particular at favorable cost and optimum effect. The invention also provides a device or fixture with which the procedure covered by the invention can be carried out in a simple and rational way.

The invention has an advantage as compared to the previous procedures of the state of the art, that an optimum bonding to the wall and/or to the surface to be insulated is ensured, when using a polyurethane layer for heat insulating purposes. Polyurethane has excellent adhesive properties, and it provides a good bond or bonding to almost every surface. When applying this material or spraying it on any surface, immediate bonding of the insulating material is ensured. It penetrates into all cavities and increases its original volume by about 40 times within a few seconds. As compared to other hard aerated plastics, an insulating layer of polyurethane foam shows a considerably more favorable diffusion resistance against steam. This means that the walls to be insulated remain dry, without any additional measures to be taken.

Contrary to the insulating procedure with hard aerated plastics boards, large areas can be insulated in one operation by using the procedure as described by the invention, and smoothened and trimmed perfectly by means of a special chain saw used for this purpose. In order to determine the thickness of the polyurethane layer, supporting strips or pipes are fixed parallel to each other on the surface to be insulated, along which an extra-long chain saw is used for trimming and smoothing the finished surface.

The supporting strips are removed after smoothening the surface, and the resulting gaps are also filled with polyurethane foam. Final smoothing and trimming of these small areas can be done by a sharp electric knife or similar tool.

Pipes are advantageously used as supporting or smoothing strips. They can have a length of 6 m or more at a pipe diameter of 2 cm, in order to treat large areas at the same time. Spacer bushes are used to fix the pipes by bolts on the surface to be insulated or treated. In this procedure, the length of the spacer bush and the pipe thickness add up to the level of the finished height of the polyurethane layer to be applied. Different levels of the polyurethane layer can be obtained by using different spacer bushes. The thickness of the supporting strips or pipes used should be as small as possible to allow the polyurethane foam to expand and pass under the supporting pipes while swelling. Pipes of a diameter of approximately 20 mm and arranged in parallel at a distance of approximately 1 m to each other have proved successful with regard to mechanical strength and simple handling.

The invention provides a special chain saw to be used for the procedure. This chain saw is similar to a wood saw having an extra-long blade of more than 1 m, in order to cover the distance between the two supporting strips arranged in parallel to each other. It is furthermore provided that the chain links of the saw are equipped with an increased number of cutting tips as compared to conventional chain saws, in order to ensure smooth cuts along the surface to prevent any refinishing. In this connection it is of particular advantage to arrange brushes made of V2A-steel between the chain links of the saw, in order to remove the saw dust or powder from the cutting surface.

Accordingly, it is an object of the invention to provide an improved device for smoothing insulation surfaces which have been sprayed onto a wall between spacer strips.

A further object of the invention is to provide an improved method of coating a wall which includes spraying an insulation material such as a foaming polyurethane layer onto a wall surface up to the thickness set by two strips which are applied to the wall surface and extend outwardly therefrom up to the desired layer thickness of the insulation.

A further object of the invention is to provide a device for smoothing the surface of applied foam insulation which is simple in design, rugged in construction and economical to manufacture.

The various features of novelty which characterize the invention are pointed out with particularity in the claims annexed to and foring a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
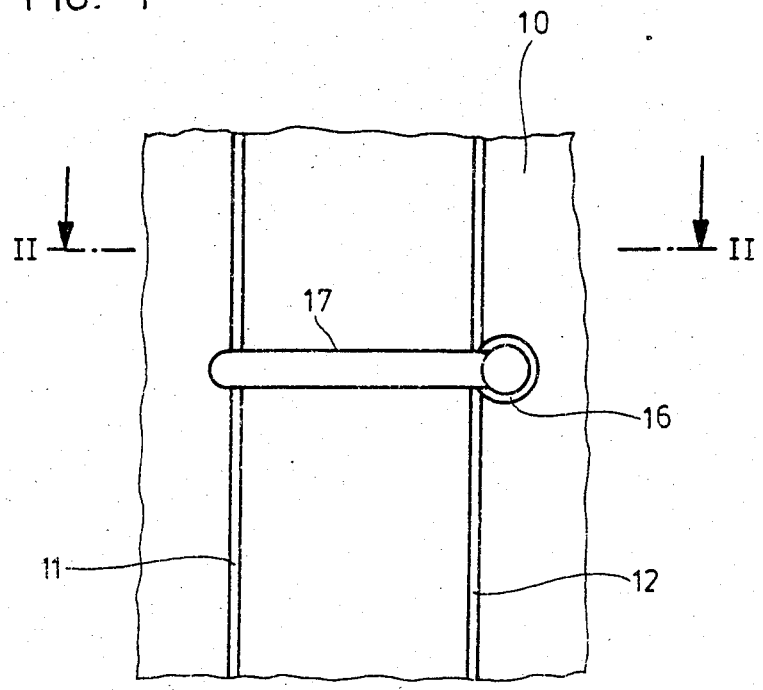
FIG. 1 is a partial elevational view of a wall surface such as a ceiling or vertical wall showing a smoothing device in position for smoothing an insulation surface which is applied between supporting or smoothing strips in accordance with the invention.

Referring to the drawings in particular the invention embodied therein comprises a method of applying an insulation coating to a wall surface 10 which comprises applying strips 11 and 12 of a length corresponding to the length of the insulation coating to be applied to the wall surface 10 so that they are disposed outwardly of the wall surface up to the desired thickness of the insulation coating. Thereafter the insulation coating is sprayed between the adjacent strips 11 and 12 of a thickness up to the surface of the strips. Thereafter a smoothing device such as a chain saw 16 is used to smooth off the surface of the applied insulation.

Figure 2:
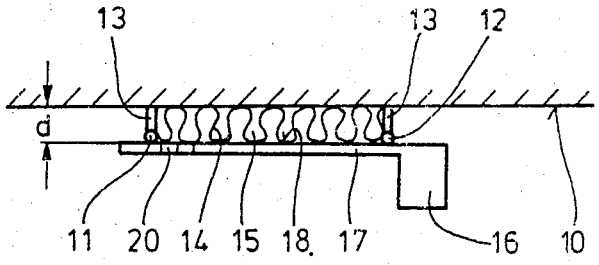
FIG. 2 is a section taken along the line I—I of FIG. 1.

Two or more supporting strips 11 and 12 in the form of pipes are bolted onto the wall or ceiling 10 at special locations by means of spacer bushes 13, as illustrated in FIGS. 1 and 2. The fixing bolts (not shown) must be counter-sunk in the pipe to provide a smooth and well aligned surface of the supporting strips. The length of the spacer bushes 13 must be chosen in such a way that their length together with the pipe diameter result in the height or thickness d of the polyurethane layer 14 to be applied. For instance, pipes of a diameter of 20 mm have to be combined with spacer bushes of a length of 20 mm, in order to ensure a thickness of the polyurethane layer to be applied of 40 mm. It is natural that these values may be varied according to requirements.

Polyurethane foam is then sprayed on or applied in the usual way on the surface within space 15 outlined by the supporting strips 11, 12 in the form of pipes. The foam cures within a few seconds, and can then be smoothened by means of a chain saw 16. The blade length 17 of chain saw 16 must be long enough in order to cover the free space between the pipes 11 and 12.

The chain 16 is provided on all chain links or on every second link of the chain while cutting tips, arranged at least on the trimming or smoothing side 18 of saw blade 17, in order to considerably increase the cutting performance of the chain saw. It is also possible to fix or braze small brushes made of V2A-steel on that side, which are intended for further smoothening or dust removal from the surface.

A suitable chain saw 16 for this procedure would have, for instance, a speed of approximately 4000 rpm, a power of 1100 watts, and a chain feed of 300 mm/sec.

The invention is suited in particular for heat insulating procedures on outside walls of new buildings, improvements and old buildings in development areas, etc. Conventional plaster can be applied directly on the outside of the insulating layer applied according to the invention.

It is natural that the invention can also be used within buildings.

The invention thus provides a procedure and device for carrying out the procedure of coating and heat insulating of walls, ceilings, etc. on buildings. For this purpose, a polyurethane layer is applied between supporting strips arranged in a way that their distance from the wall determines the thickness of the layer to be applied. An extra long chain saw is used to smoothen and trim the surface along the level of the supporting (smoothing) strips.

While specific embodiments of the invention have been shown and described in detail to illustrate the application of the principles of the invention, it will be understood that the invention may be embodied otherwise without departing from such principles.

What is claimed is:

1. A method of applying an insulation coating to a wall surface, comprising applying strips of a length of the insulation coating to be applied to the wall surface, so that the strips are disposed outwardly of the wall surface up to the desired thickness of the insulation coating and so that the strips are fixed to the wall surface, the strips defining a space therebetween, spraying the coating between adjacent strips to fill the space therebetween and to a thickness at least up to the surface of the strips, and thereafter smoothing the coating which has been applied back to the desired thickness of the insulation coating and back to a plane which abuts outer portions of the strips.

2. A method according to claim 1, wherein pipes are used as the strips and including bolting the pipes to the surface to be coated with a spacer between the pipe and the surface of a length corresponding to the desired thickness to be applied.

3. A method according to claim 1, wherein the strips are fixed to the wall at parallel spacing to each other of a approximately 1 meter apart, and wherein the strips are several meters long.

4. A method according to claim 1, wherein the strips are removed after the coating process and including applying insulation in the gaps formed by the strips.

5. A method according to claim 1, wherein the strips comprise pipe members and including bolting the pipe members to the surface before the applying of the insulation and wherein the insulation is a polyurethane foam.

6. A method according to claim 1, including smoothing the coating by passing a chain saw along the plane and against the strips.

7. A method according to claim 4, including smoothing the coating by passing a chain saw along the plane and against the strips.

8. A method according to claim 5, including smoothing the coating by passing a chain saw along the plane and against the strips.

* * * * *